United States Patent [19]

Singer

[11] Patent Number: 4,830,084

[45] Date of Patent: May 16, 1989

[54] SPRAY CASTING OF ARTICLES

[76] Inventor: Alfred R. E. Singer, 151, Derwen Fawr Road, Swansea, Glamorganshire, Wales

[21] Appl. No.: 168,563

[22] Filed: Mar. 7, 1988

Related U.S. Application Data

[63] Continuation of Ser. No. 403,428, Jul. 30, 1982, abandoned, which is a continuation of Ser. No. 92,956, Nov. 9, 1979, abandoned, which is a continuation of Ser. No. 921,761, Jul. 3, 1978, abandoned, which is a continuation of Ser. No. 754,844, Dec. 27, 1976, abandoned, which is a continuation of Ser. No. 589,599, Jun. 23, 1975, abandoned.

[30] Foreign Application Priority Data

Jun. 28, 1974 [GB] United Kingdom ..... 28769/74

[51] Int. Cl.[4] ..... B22D 11/10

[52] U.S. Cl. ..... 164/46; 164/47; 164/497; 164/66.1; 164/117; 164/259; 164/286

[58] Field of Search ..... 164/114, 117, 133, 136, 164/61, 65, 66.1, 256, 259, 286, 46, 495, 497, 508, 47, 19; 427/28, 31, 421, 422; 118/317, 323, 626

[56] References Cited

U.S. PATENT DOCUMENTS

| | | | |
|---|---|---|---|
| 2,129,702 | 9/1938 | Merle | 164/114 |
| 2,864,137 | 12/1958 | Brennan | 164/46 |
| 2,894,485 | 7/1959 | Sedlacsik, Jr. | 118/323 X |
| 3,442,688 | 5/1969 | Pettigren | 427/31 |
| 3,689,987 | 9/1972 | Teague | 164/46 |
| 3,721,286 | 3/1973 | Paton et al. | 164/495 |
| 3,826,301 | 7/1974 | Brooks | 164/46 |

FOREIGN PATENT DOCUMENTS

| | | | |
|---|---|---|---|
| 809956 | 3/1959 | United Kingdom | 164/46 |

OTHER PUBLICATIONS

Hodkin, et al., "Centrifugal Shot Casting", *Powder Metallurgy*, vol. 16, No. 32, 1973, pp. 278–287.

Jones, et al., "Rotary Atomizing Technique for Bulk Splat Cooling", Journal of Physics E: Scientific Instruments, vol. 4, 1971, pp. 671–674.

*Primary Examiner*—Timothy V. Eley

*Attorney, Agent, or Firm*—Stevens, Davis, Miller & Mosher

[57] ABSTRACT

Apparatus for the production of a metal article comprises means for maintaining a reservoir of molten metal with a free surface, means for rotating the free surface of the reservoir about an axis such that the molten metal is atomized and thrown outwardly away from the said surface by centrifugal action, and a substrate in the path of the atomized particles of said molten metal, whereby a solid article may be built up on the substrate by solidifying the atomized particles thereon. The molten metal may be produced by melting an electrode or otherwise.

An annular solid metal article is disclosed having excellent mechanical properties. The solid metal article is produced in a single step by a spray deposition process. Molten metal is centrifugally atomized to splat and build up on a cooled mold surface disposed around the centrifuge means. Controlled relative reciprocatory movement in the direction of the rotational axis of the centrifuge is provided. By regulating this relative movement appropriately, the shape and width of the deposited article is determined. The process is carried out in an oxygen-free atmosphere. The product is a fully integrated solid, substantially free from voids, in which the original splat particle boundaries are almost undetectable, and grain growth occurs freely across the original particle boundaries.

5 Claims, 1 Drawing Sheet

SPRAY CASTING OF ARTICLES

Figure 1:
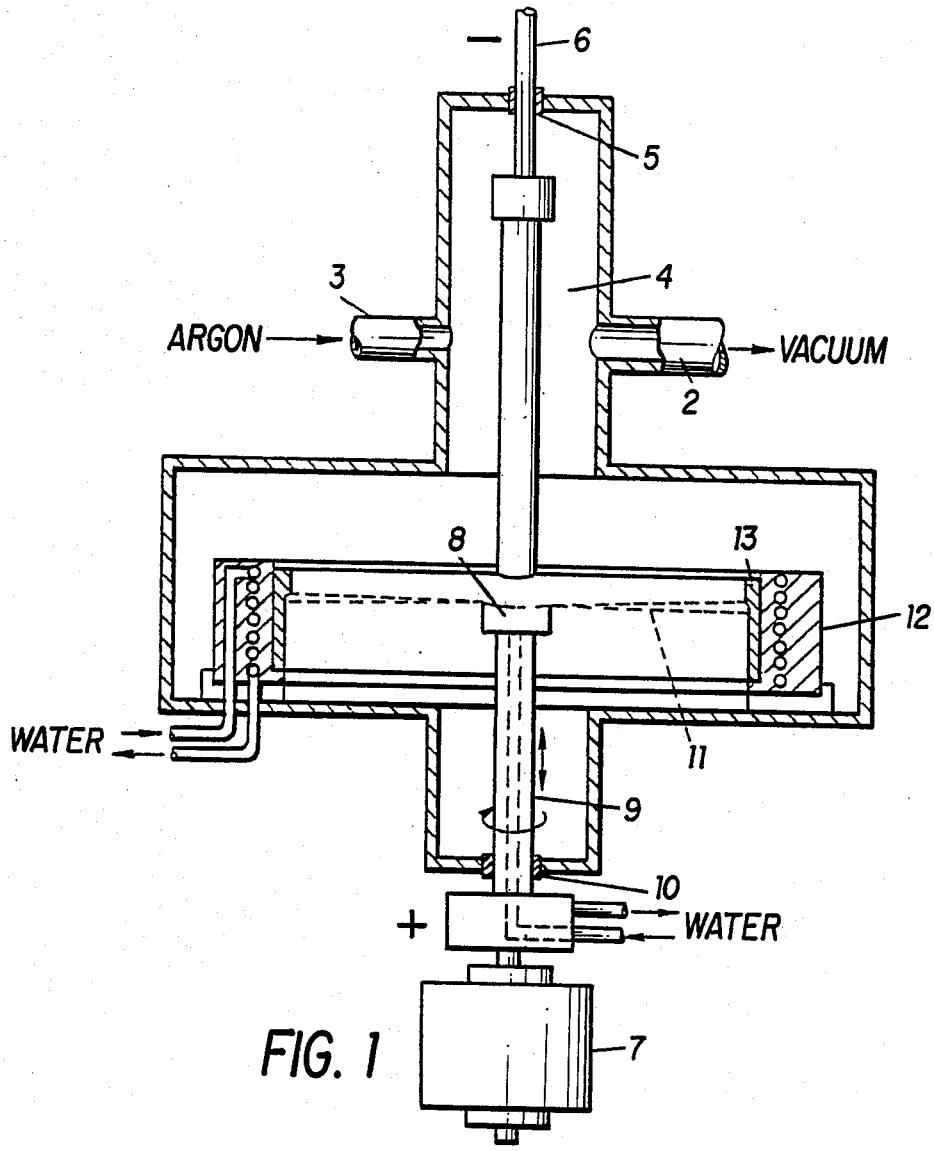

This application is a continuation of application Ser. No. 403,428, filed July 30, 1982, which in turn is a continuation of application Ser. No. 092,956, filed Nov. 9, 1979, which in turn is a continuation of application Ser. No. 921,761, filed July 3, 1978, which in turn is a continuation of application Ser. No. 754,844, filed Dec. 27, 1976, which in turn is a continuation of application Ser. No. 589,599, filed June 23, 1975 which are all now abandoned.

Many metal articles having rotational symmetry are required to have high mechanical properties to fit them for their intended use. Such articles are frequently made by forging a cast ingot, extruding a block of the metal or ring rolling a pierced billet. An example is the long and expensive forging procedure carried out when gas turbine discs are fabricated from cast metal blocks. The production of such shapes by conventional casting but without subsequent plastic deformation is not generally considered practicable when the highest mechanical properties are required in a comparatively large section, because of the coarse and segregated structures that usually result from conventional casting. In the case of certain alloys containing substantial quantities of such metals as Ti, Cr and Al it is often important to reduce the oxide level to an extremely low value to ensure good mechanical properties. Many such high temperature alloys cannot readily be forged, and other conventional fabricating methods involving powder metallurgy followed by a limited degree of forging are difficult to accomplish without some contamination with atmospheric oxygen. This produces an oxide film which persists at the original particle boundaries with consequent weakening of the structure.

In the above cases it is generally considered impracticable to produce the product in one operation with designed variations of alloy composition within the product to achieve different mechanical properties at specific locations in the product. Yet such a heterogeneous product may be best suited to some service conditions. To overcome this difficulty certain highly stressed products such as turbine blades are occasionally produced by assembling several different parts of differing composition and structure despite the very high cost involved in the procedure.

It has no been found possible to produce metal products by a centrifugal spray casting method which will achieve fine grain size with a minimum of undesirable segregation and in many cases with enhanced mechanical properties. This may readily be achieved under controlled atmospheric conditions with minimal contamination by oxygen or other deleterious substances. Moreover, if required, it is now possible using the apparatus and process of the invention to produce a variation (within certain practical limitations) of alloy composition at certain locations in the product at will.

In accordance with the present invention, there is provided an apparatus for producing an annular solid metal article by building up splatted droplets one upon another, the apparatus comprising:

a. a housing defining an enclosure,
b. centrifuge means disposed in the housing for atomizing molten metal solely by centrifugal force,
c. means operatively associated with the housing and centrifuge means for melting metal and supplying the resulting molten metal to the centrifuge means, d. a mold surface disposed around the centrifuge means and spaced radially outwardly therefrom in the path of molten metal droplets flung by centrifugal force from the centrifuge means,
e. means operatively associated with the housing for cooling the flattened-out molten metal droplets,
f. means operatively associated with the centrifuge for rotating the centrifuge,
g. means operatively associated with the housing for providing relative reciprocating movement of regulated amplitude between the mold surface and the centrifuge means, and
h. means opertively associated with the housing for maintaining an oxygen-free atmosphere in the space enclosed by the housing.

In accordance with the present invention, there is also provided a process for the production of an annular solid metal article by building splatted droplets upon one another, the process comprising the steps of:

a. providing a supply of molten metal to a centrifuge means within a housing,
b. rotating the centrifuge means about an axis so as to atomize solely by centrifugal force the molten metal supplied to it and thereby throw a plurality of molten metal droplets in directions outward from the centrifuge means and substantially normal to the axis,
c. solidifying and cooling the molten metal droplets by splatting them on a cooled substrate disposed around the centrifuge means and spaced radially outward therefrom,
d. providing relative reciprocatory movement in the direction of the axis between the substrate and the centrifuge means whereby the molten metal droplets splat on the substrate at locations which vary with time in the axial direction,
e. regulating the amplitude of said reciprocatory movement to shape and determine the width of the article, and
f. maintaining a substantially oxygen-free atmosphere within the housing; whereby the splatted droplets build up on one another to form a solid shaped metal article.

In accordance with the present invention, there is yet provided a shaped solid metal article comprising a seamless annular member constituting a plurality of splat particles which have built one upon another, and constituted by a plurality of crystalline grains of which at least one extends across a boundary between two of said splat particles.

When carrying out the process, the supply of molten metal may be maintained by pouring metal from a separate vessel into the centrifuge means.

A controlled supply of the molten metal may be provided by striking an electric arc between a consumable electrode formed of the said metal, and a non-consumable electrode, and feeding the consumable electrode in controlled manner towards the non-consumable electrode.

According to an advantageous feature of the invention, the composition of the metal supplied to the centrifuge means may be varied during the production of the article. Where a rotating dish is employed, this may be achieved by varying the composition of the molten metal supplied to the dish. Where a consumable electrode is employed, as the centrifuge means the composition of the consumable electrode may be varied along its length in the direction of feed.

Advantageously the process is carried out in an environment which is inert to the metal used, for example in vacuo, or in an argon atmosphere.

Figure 2:
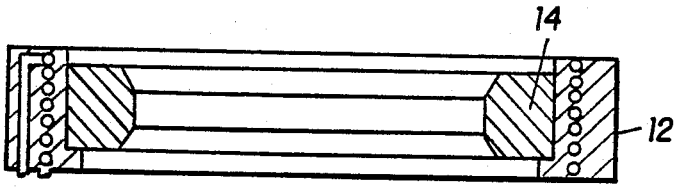
Figure 3:
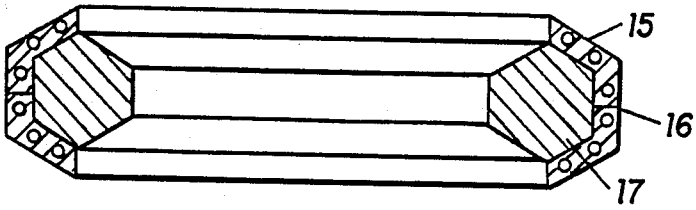

A still further aspect of the invention comprises an article produced by an apparatus or process in accordance with the invention. The invention will now be described by way of example only, with reference to the accompanying drawings in which FIG. 1 is a sectional diagrammatic representation of an apparatus in accordance with the invention, and FIGS. 2 and 3 are sectional diagrammatic representations of moulds for use in the apparatus of FIG. 1, containing articles produced in accordance with the invention.

Referring now to FIG. 1, apparatus for the production of a thick ring by spray casting comprises a large chamber 1 of circular cross-section fitted with a large port (not shown) giving access to the interior for servicing. The chamber 1 is capable of being evacuated from a port 2 and filled with an inert gas such as argon from a port 3. A consumable metal electrode 4 is fed in from the top of the chamber through a seal 5 between the chamber and the electrode holder 6 and an electric arc is struck between the consumable electrode and a water cooled copper crucible or dish 8, which acts as a non-consumable electrode. The crucible is rotated at speeds between 500 and 10,000 rpm by a motor 7 placed outside the chamber, through a driving shaft 9 which passes through a seal 10. A heavy current is passed to form an arc and molten metal is transferred from the electrode to the rotating crucible from the rim of which it is thrown off nearly tangentially, as an atomised spray of small droplets of molten metal 11. The magnitude of the current required will be of the order of a thousand amps and will depend inter alia upon the electrode size, which might be up to about 3" diameter, or more.

The droplets rapidly assume a near spherical shape and impinge on a substrate in the form of a water cooled copper mould 12 having a cylindrical inner surface which surrounds the rotating crucible. The mould is provided with a lower, inwardly directed lip which prevents the cast article from slipping out of the mould during the casting process.

The droplets immediately splat into the form of minute pancake shapes on the mould surface and solidify extremely rapidly. The first layer of particles is quickly covered by another and the layers build up to form a coherent article 13 in the form of a ring. To obtain the required cross-sectional shape of the ring 13, the rotating crucible and the consumable electrode are given an appropriate reciprocating vertical motion through the shaft 9 and the electrode holder 6 respectively, as spray deposition continues. In this way a ring of the required dimensions and cross-section may be built up. When the required dimensions are achieved the current is switched off and the electrode is withdrawn, the rotation of the crucible is stopped, the port of the main chamber giving access to the interior is opened and the mould, together with the spray cast ring, is withdrawn. It will generally be found that the spray cast ring will detach itself readily from the tubular mould. Difficulties resulting from differential thermal expansion are not normally encountered, because the splat particles are very much hotter than the mould surface when they are deposited. The spray cast article will therefore generally tend to contract inwardly, away from the mould surface, even when the mould material has a relatively high expansion co-efficient. If the geometric shape of the cast article is such that it cannot be separated from the mould, a split mould arrangement may be employed.

Typically the equipment is run at approximately atmospheric pressure although other pressures may be used.

The centrifugal atomising of metals is a known tecniques, and guidance on this aspect may be obtained from a paper by Hodkin, Sutcliffe, Mardon and Russell in "Powder Metallurgy 277, 32, 1973," which describes a method for the manufacture of atomised metal shot by shot casting.

The total quantity of gas used to generate the atmosphere is small and good gas circulation is brought about by the rotating crucible which can be an advantage in certain circumstances. To increase the cooling rate of the spray deposit the external walls of the chamber may be water cooled if desired.

The atomised particles travel from the crucible to the mould surface approximately in a horizontal plane, having a very small spread in a vertical direction. The vertical spread will decrease with increasing rotational speed of the crucible and with increasing particle size. In normal circumstances the spread will not exceed 0.2" at the mould surface for particles more than 100 $\mu$m diameter. The process is particularly useful for products having rotational symmetry together with a central circular hole. Nevertheless, apparatus employing an eccentric mould can be envisaged in which a non-symmetrical article might be produced in accordance with the invention. The mould surface is covered with the spray deposit by reciprocating the rotating crucible or the mould in a vertical direction. Subsequent layers of particles are laid down in the position required by the appropriate vertical movement of the crucible or the mould. For instance, by appropriately regulating the vertical movements a shaped spray casting 14 shown in FIG. 2 can be produced using the simple cylindrical mould 12. A more complex shaped spray casting such as that shown in FIG. 3 may require a more complex mould 15 which is the case illustrated would be split at a position 16 to enable the finished spray casting 17 to be removed.

Water cooling of the mould may be required in many cases. If it is required to cool the metal droplets as rapidly as possible and to keep the temperature of the product relatively low during the spray casting operation then the vertical movements of the crucible or the mould can be carried out rapidly and in a reciprocating manner such that during any one vertical reciprocating movement only one or a few layers of splatted particles are deposited in any one area before moving to a neighbouring area. When the spray returns to the original area the earlier deposited particles will have cooled to a relatively low temperature and will be capable of chilling newly deposited particles. Certain alloys such as those in which one phase has a limited solubility in another can benefit greatly from such very rapid chilling. In such cases it may lead to extended solid solubility followed by the subsequent precipitation of the solute phase in the form of fine particles, leading to enhanced mechanical properties in the product.

It will usually be found that as the thickness of the deposit builds up, so reducing the flight distance between the deposit and the crucible, it is desirable to reduce the mass rate of deposition. The rate of deposition can be controlled by means of the voltage and current supplying the arc, and by the rate of feed of the electrode into the crucible.

If it is desired to deposit one alloy composition in one part of the article and another in a different part, or if the gradual change of alloy composition is required, this can be achieved by using electrodes which have the required alloy composition changes along their length, and ensuring that during burn-off the various compositions are deposited in the appropriate areas of the article. Such articles find application as rotor discs for gas turbine engines, in which good high temperature properties are required at the periphery of the disc, while superior mechanical properties at lower temperatures are required near the centre of the disc.

As an example, high temperature, high strength nickel base Ni-Cr-Ti-Al alloy annular discs can be produced by the process in which the Al and Ti content is highest at the periphery and lowest at the inner surface of the annulus. The required variation may be accomplished by using an electrode composed of sections or parts of graded composition welded together so that the electrode composition is highest in Al and Ti at the bottom (ie the first part to be deposited), and lowest in Al and Ti at the top (ie the last part to be deposited). Suitable electrodes having the required alloy compositional gradations along their lengths can be assembled from powder, pieces or ingot sections.

An effective method of achieving the required compositional gradation in an electrode and at the same time ensuring high integrity is to cast the electrode using a variant of the well known Electro-flux re-melting and casting procedure. In the case under consideration an initial electrode composed of powder or pieces welded together to give the required overall compositional gradient along its length is fed into the Electro-flux equipment and a continuously cast bar is produced incorporating the same compositional gradient along its length as the initial electrode. The continuously cast bar may then be used as the consumable electrode for the process of the invention. Because of the high degree of stirring associated with the Electro-flux re-melting process, radial compositional variation in the continuously cast bar is negligible, but the required longitudinal compositional variations are preserved.

Care must be taken when designing a compositional gradient in a spray cast product. In many cases, as for example in the case of the nickel base Ni-Cr-Ti-Al alloys, it is possible to benefit from a gradation of composition because there may be no intermediate compositions at which mecahnical properties are unacceptably poor. In certain alloy systems there may be composition ranges, intermediate between the desired optimum ones, whose properties fall to unacceptable values. Such alloy systems should be avoided when planning variations. The heat treatment of spray cast products having major compositional variations must also be given careful consideration. Heat treatment will encourage diffusion which tends to cancel out compositional variations. A compromise heat treatment procedure may have to be accepted, rather than the conventional heat treatments most suited to compositions at the extremes of the compositional range used in the article.

Although the preferred method of operating the process is to feed a consumable electrode into an arc struck between the crucible and the consumable electrode, other means of supplying molten metal for the process can be used.

For example a non-consumable electrode may be used in conjunction with a rotating consumable electrode to supply molten metal, in which case high integrity and mechanical strength is required in the consumable electrode for it to be able to withstand the forces generated by the high rotational speeds which must be used.

Alternatively the molten metal for centrifugal atomising may be supplied by pouring a stream of molten metal onto the rotating surface of an open crucible or dish. The dish may be hollowed out, or for some applications even a flat disc would be appropriate. Planned compositional variations in the product can then be brought about by a similar variation in the alloy composition of the molten metal feed. For example the molten metal may be supplied to the rotating surface from a tundish which in turn may be supplied with the molten metal of say two different compositions. The first composition would be that required in the part of the product first deposited and the second in the part last deposited. If required, the supply of the first molten metal to the tundish may at any time be progressively reduced and the supply of the second progressively increased. Mixing in the tundish and on the rotating surface is highly effective and a gradual change of composition will accordingly be achieved. Other alternatives such as the use of two consumable electrodes and the feeding of granules into a rotating crucible through a hollow electrode might be envisaged. These methods can likewise be adapted to give the required compositional gradients.

A preferred material for the rotating crucible or dish is copper, which desirably is water-cooled, but it is possible to use other metals as crucible materials, and also carbon may be used in some cases.

It is possible to use an indirect arc process with consumable electrodes and a non-conducting rotating refractory crucible as a source of atomised metal particles.

The surface condition of the mould surface at the commencement of deposition is an important matter. A very smooth mould surface imparts a rough indented external surface of the general appearance of orange peel to the spray cast product which is generally prejudicial to its subsequent use. A slightly roughened surface, for instance that produced by light grit blasting, give a smooth external surface to the product. The mould surface must not however, be too rough otherwise there might be difficulty in releasing the product from the mould.

Because the metal is deposited under conditions where oxygen is rigidly excluded the spray cast product will generally have very low porosity. The absence of oxide films at the original splat particle boundaries allows grains to grow through the original particle boundaries leading to a very high degree of integrity and good mechanical properties. This is an essential feature of the process. It is thought that the sudden increase in the particle surface area caused by the splatting action also assists in the obliteration of the original particle boundaries. In many alloys the very rapid chilling of the particles on deposition may lead to extended solid solubility and subsequent enhancement of mechanical properties as mentioned hereinbefore.

An example is given below of the mechanical properties that can be achieved by spray casting a short tube 16" diameter and ¼" wall thickness in a high strength, high temperature nickel base alloy, using the apparatus described with reference to FIG. 1. Test pieces were cut in the vertical (ie longitudinal) direction of the tube and were tested in the "as cast" state. The alloy contained 75% Ni, 20% Cr, 2% Ti and 1.5% Al and was spray cast in an argon atmosphere using a stationary consumable electrode in conjunction with a water cooled copper crucible 3" in diameter rotating at 3,000 rpm. The consumable electrode was made the cathode and was connected to a DC supply operating at 80 V open circuit, giving a current of approximately 2,000 amps during deposition. The tube was spray deposited onto a thick water cooled copper ring which acted as a substrate. The mechanical properties of the deposited ring material were ultimate tensile strength of 52 tons/square inch and elongation of 28%. The properties represent a marked improvement over conventional castings, especially in terms of elongation. Conventional castings in the same alloy using sand or investment techniques give "as cast" properties in the region of ultimate tensile strength 34 tons/sq in with an elongation of 6%. A further improvement in properties can sometimes be obtained by subsequent heat treatment, or by mechanical working, or both.

The invention is applicable to a very wide range of metals and alloys but it is particularly beneficial in the case of aluminium and its alloys, alloy steels, high nickel and chromium alloys and titanium and its alloys.

In these latter materials the invention offers considerable benefits over routes based on conventional powder metallurgy where small amounts of oxide on the surfaces of the original powder particles are necessarily incorporated into any product made from them. Thus in the case of high nickel alloys with chromium titanium and aluminium made by conventional powder metallurgy, "decoration" of the original powder particles with carbides frequently occurs at the original powder particle boundaries with detrimental effect on the mechanical properties. Using the process of the invention with the same alloys no such "decoration" occurs and new grains grow unhindered across the original splat particle boundaries.

Mould surfaces may be made of a variety of commonly used mould materials. In most cases either steel or copper will be found effective. In many cases it is necessary to water cool the mould surface in order to achieve the required degree of chilling in parts of the spray casting.

It will be necessary to provide means for raising and lowering the rotating surface or the mould surface to provide relative reciprocatory movement therebetween and in the case of electrode melting processes it will generally be necessary to provide means for raising and lowering the electrode. If the metal source is a stream of molten metal poured from a crucible or tundish then means may be provided for pouring the metal onto the rotating surface under a controlled atmosphere or under vacuum.

Although some metal articles may be made by the process without the need for special atmosphere control other than the exclusion of oxygen it is usual to carry out the operation in an inert environment which may be for example a vacuum, or an inert gas. Suitable inert atmospheres include argon which is suitable for most metals and nitrogen which in some cases is suitable for aluminium. Occasionally hydrogen or other reducing gases may be used.

Although the spray cast product is frequently usable in the "as cast" or the heat treated state it is sometimes required to improve the properties still further by subsequent operations such as hot or cold isostatic pressing, forging or ring rolling. These are known procedures for which the spray cast products are generally suitable.

One advantage of the process is that in many cases the action of dividing the molten metal into a large number of small molten particles, thereby increasing the total surface area and reducing the diffusion distances within each particle, causes the molten metal particles to be degassed in flight. This is particularly advantageous with certain steels where the presence of dissolved hydrogen is castings and forgings can be highly detrimental when the product is to be highly stressed in use. It will be frequently found that the amount of dissolved hydrogen in the molten metal is high such that if it soldidified under normal conditions the hydrogen content of the solid would for example be greater than 10 ppm. In such cases the spray deposited product will have an appreciably lower hydrogen content, for example only 2 ppm, if the process of the invention is conducted in a hydrogen free atmosphere or in one in which the hydrogen is maintained at a very low level by continuous evacuation.

The aim is to ensure that the partial pressure of hydrogen in the atmosphere is very low, in which case hydrogen diffuses rapidly out of the molten metal particles in flight because of the small diffusion distances within the particles and their large surface area in relation to their volume. The degassing process is strongly dependent on particle size and proceeds very rapidly with small molten particles.

The lowering of the hydrogen level is particularly marked when reduced pressures are used during spray deposition. The effect is very similar to the well known vacuum degassing of steel in which the steam of molten steel is allowed to fall into a mould in an evacuated chamber. Hydrogen bubbles nucleate and expand in the falling metal disrupting it and breaking it up into small particles. In the case of the invention the molten metal stream is of course broken into liquid particles by centrifugal action, moreover the particle size is generally much smaller than with the conventional vacuum degassing.

Although the particle velocity is greater and distances travelled by the molten particles are shorter in the invention than in conventional vacuum degassing of steel, the total effect is similar because of the smaller particle size in the invention.

I claim:

1. In a method for making an annular metal article which comprises spray casting a molten metal against a supporting surface and shaping and cooling the resulting metal deposit, the improvement which comprises casting molten metal droplets in an oxygen-free atmosphere in a single uninterrupted step solely by centrifugal force from a rotating surface against a cooled annular surface under conditions whereby the said molten metal droplets splat into the form of minute pancake shapes when the droplets strike the said cooled annular surface to form splats overlapping one another which coalesce to form a substantially unitary-metal layer of very low porosity and improved density, and simultaneously effecting relative reciprocatory movement in the direction of the rotational axis of the rotating surface to determine the shape and width of metal deposaited on the said cooled annular surface, whereby the original boundaries between metal splats are substantially erased and grain growth occurs across said boundaries to form an annular article, said molten metal being caused to impinge upon the said rotating surface at the central axis thereof.

2. A spray deposition process for the production of an annular solid metal article comprising the steps of:

providing a supply of molten metal to a centrifuge means within a housing, providing a cooled substrate within the housing, said substrate being spaced from the disposed around the centrifuge means, maintaining a substantially oxygen-free atmosphere within the housing, rotating said centrifuge means about its central axis so as to atomize solely by centrifugal action the molten metal supplied to it and thereby throw a plurality of molten metal droplets in directions outward from said centrifuge means and substantially normal to said axis, said molten metal being caused to impinge upon the said rotating centrifuge means at the central axis thereof, and providing controlled relative reciprocating movement betweenw the substrate and the rotating centrifuge means in the direction of the said central axis whereby the molten metal droplets are deposited on the substrate at locations which vary in the axial direction with time in a predetermined way; the operating conditions including the velocity and temperature of the molten atomized particles on impact with the substrate, the degree of substrate cooling, and the rates of deposition, all being such that the molten particles are each deposited on the substrate as splat particles, that is to say as molten particles each of which on impact with the substrate rapidly spreads sideways into a thin pancake shape and solidifies rapidly in the place where it was deposited, whereby the annular solid metal article is formed of a plurality of splat particles built up in successive layers one upon another, such that grains grow through boundaries of said splat particles, the shape of the article being determined by the said controlled relative reciprocating movement.

3. The process of claim 2 wherein a supply of molten metal is provided by striking an arc between a consumable metal electrode and said centrifuge means.

4. The process of claim 2 wherein the composition of the molten metal supplied to the centrifuge is caused to vary with time.

5. The process of claim 2 wherein said solid shaped metal article contracts inwardly from said cooled substrate.

* * * * *